US007678229B2

(12) United States Patent
Wilke, II

(10) Patent No.: US 7,678,229 B2
(45) Date of Patent: Mar. 16, 2010

(54) PROCESS FOR HIGH ENGAGEMENT EMBOSSING ON SUBSTRATE HAVING NON-UNIFORM STRETCH CHARACTERISTICS

(75) Inventor: Nicholas Jerome Wilke, II, Independence, KY (US)

(73) Assignee: The Procter & Gamble Company, Cincinnati, OH (US)

( * ) Notice: Subject to any disclaimer, the term of this patent is extended or adjusted under 35 U.S.C. 154(b) by 466 days.

(21) Appl. No.: 11/516,892

(22) Filed: Sep. 7, 2006

(65) Prior Publication Data

US 2007/0056704 A1 Mar. 15, 2007

Related U.S. Application Data

(63) Continuation-in-part of application No. 11/222,701, filed on Sep. 9, 2005, now Pat. No. 7,597,777.

(51) Int. Cl.
*B31F 1/07* (2006.01)
*D21H 27/02* (2006.01)

(52) U.S. Cl. ..... 162/117; 162/123; 428/154; 428/174

(58) Field of Classification Search ..... 162/109–117, 162/361, 204–207, 362, 123, 132; 428/153, 428/154, 156, 182–186, 174, 180
See application file for complete search history.

(56) References Cited

U.S. PATENT DOCUMENTS 1,863,973 A 6/1932 Ellis, Jr.

(Continued)

FOREIGN PATENT DOCUMENTS

DE 18 07 842 A1 7/1969

(Continued)

OTHER PUBLICATIONS

PCT Search Report Mailed Jul. 4, 2007 (12 pages).
Hakle, Super Vlaush Toilet Paper Sample Sold 2003.
Hakle, Super Vlaush Toilet Paper Package.

*Primary Examiner*—Eric Hug
(74) *Attorney, Agent, or Firm*—Betty J. Zea

(57) ABSTRACT

The present invention provides a process for producing a deep-nested embossed paper product comprising the steps of delivering one or more plies of paper to an embossing apparatus and embossing the one or more plies of the paper between two opposed embossing cylinders. The one or more plies of paper have a first direction and a second direction that is perpendicular to the first direction where both the first and second directions are in the plane of the paper and the one or more plies of paper have a stretch characteristic in the first direction that is higher than the stretch characteristic in the second direction. Each of the embossing cylinders having a plurality of protrusions, each of which have a height, where the embossing protrusions are disposed in an overall non-random pattern where the respective overall non-random patterns on the cylinders are coordinated to each other and the two embossing cylinders are aligned such that the respective coordinated overall non-random patterns of embossing protrusions nest together such that the protrusions engage each other to a depth of greater than about 1.016 mm. The overall non-random pattern of protrusions comprises a plurality of emboss regions where each of the emboss regions comprising a fraction of the total number of protrusions in the overall non-random pattern. All of the protrusions within an embossing region have about the same height and the pattern of protrusions within an emboss region creates a localized primary line of stress on the paper as the plies of paper are embossed where the line of stress has a component in the first direction and a component in the second direction. The height of the protrusions within an embossing region having a higher line of stress component in the first direction is greater than the height of the protrusions in an embossing region having a lower line of stress component in the first direction.

2 Claims, 7 Drawing Sheets

U.S. PATENT DOCUMENTS 3,414,459 A 12/1968 Wells
3,556,907 A 1/1971 Nystrand
3,668,055 A * 6/1972 Gerard ..... 428/184
3,672,950 A 6/1972 Murphy et al.
3,673,060 A 6/1972 Murphy et al.
RE27,453 E * 8/1972 Schutte et al. ..... 162/117
3,684,603 A 8/1972 Iltis
3,708,366 A 1/1973 Donnelly
3,867,225 A 2/1975 Nystrand
4,135,024 A 6/1979 Callahan
4,184,700 A 1/1980 Greenaway
4,320,162 A 3/1982 Schulz
4,325,773 A 4/1982 Schulz
4,326,002 A 4/1982 Schulz
4,339,088 A * 7/1982 Niedermeyer ..... 242/160.4
4,528,239 A 7/1985 Trokhan
4,556,378 A 12/1985 Nyfeler et al.
4,610,743 A 9/1986 Salmeen et al.
4,671,983 A * 6/1987 Burt ..... 428/179
4,717,221 A 1/1988 McGrew
4,758,296 A 7/1988 McGrew
4,759,967 A * 7/1988 Bauernfeind ..... 428/154
4,913,858 A 4/1990 Miekka et al.
4,913,911 A 4/1990 Wildt
4,921,034 A * 5/1990 Burgess et al. ..... 162/109
4,927,588 A 5/1990 Schulz
4,933,120 A 6/1990 D'Amato et al.
4,984,824 A 1/1991 Antes et al.
5,091,032 A 2/1992 Schulz
5,155,604 A 10/1992 Miekka et al.
5,158,819 A 10/1992 Goodman, Jr. et al.
5,173,351 A 12/1992 Ruppel et al.
5,269,983 A 12/1993 Schulz
5,294,475 A 3/1994 McNeil
5,339,730 A 8/1994 Ruppel et al.
5,356,506 A 10/1994 McNeil et al.
5,409,572 A 4/1995 Kershaw et al.
5,436,057 A 7/1995 Schulz
5,458,950 A 10/1995 Bredenick et al.
5,468,323 A 11/1995 McNeil
5,490,902 A 2/1996 Schutz
5,529,563 A 6/1996 Veith et al.
5,536,506 A 7/1996 Majeed et al.
5,549,790 A 8/1996 Van Phan
5,556,509 A 9/1996 Trokhan et al.
5,573,830 A 11/1996 Schulz
5,597,639 A 1/1997 Schulz
5,620,776 A 4/1997 Schulz
5,620,779 A 4/1997 Levy et al.
5,637,194 A 6/1997 Ampulski et al.
5,679,222 A 10/1997 Rasch et al.
5,686,168 A 11/1997 Laurent et al.
5,779,965 A 7/1998 Beuther et al.
5,804,281 A 9/1998 Phan et al.
5,840,404 A 11/1998 Graff et al.
5,846,636 A 12/1998 Ruppel et al.
5,868,168 A 2/1999 Mott et al.
5,874,156 A 2/1999 Schulz
5,885,417 A 3/1999 Marinack et al.
5,904,812 A 5/1999 Salman et al.
5,922,439 A 7/1999 Bredenick et al.
6,030,690 A 2/2000 McNeil et al.
6,033,523 A 3/2000 Dwiggins et al.
6,033,761 A 3/2000 Dwiggins et al.
6,077,390 A 6/2000 Salman et al.
6,077,590 A 6/2000 Archer et al.
6,086,715 A 7/2000 McNeil
6,106,928 A 8/2000 Laurent et al.
6,113,723 A 9/2000 McNeil et al.
6,129,815 A 10/2000 Larson et al.
6,129,972 A 10/2000 McNeil et al.
6,153,053 A 11/2000 Harper et al.
6,165,319 A 12/2000 Heath et al.
6,193,918 B1 2/2001 McGuire et al.
6,203,664 B1 3/2001 Oriaran et al.
6,277,226 B1 8/2001 Schulz
6,277,466 B1 8/2001 McNeil et al.
6,277,467 B1 8/2001 Dwiggins et al.
6,299,729 B1 10/2001 Heath et al.
6,302,998 B1 * 10/2001 Burgess ..... 162/109
6,331,228 B1 12/2001 Heath et al.
6,344,111 B1 2/2002 Wilhelm
6,361,308 B2 3/2002 Wendler, Jr.
6,368,454 B1 * 4/2002 Dwiggins et al. ..... 162/117
6,395,133 B1 5/2002 McNeil
6,461,720 B1 * 10/2002 Graff ..... 428/154
6,468,392 B2 10/2002 Oriarian et al.
6,524,683 B1 2/2003 Roussel et al.
6,571,673 B2 6/2003 Piazza
6,602,577 B1 8/2003 Ostendorf et al.
6,649,024 B2 11/2003 Oriarian et al.
6,699,360 B2 3/2004 Heath et al.
6,733,626 B2 5/2004 Ruthven et al.
6,755,928 B1 6/2004 Biagiotti
6,802,937 B2 * 10/2004 Johnston et al. ..... 162/117
6,887,349 B2 5/2005 Ruthven et al.
6,911,573 B2 6/2005 Chen et al.
7,285,317 B2 * 10/2007 Biagiotti et al. ..... 428/166
7,320,821 B2 * 1/2008 Prodoehl ..... 428/174
2002/0180097 A1 12/2002 Giachetto et al.
2003/0008109 A1 1/2003 Basler et al.
2003/0021953 A1 1/2003 Graff
2003/0111169 A1 6/2003 Baggot et al.
2003/0192662 A1 10/2003 Heath et al.
2004/0038006 A1 2/2004 Biagiotti
2004/0163783 A1 8/2004 Muller
2004/0166290 A1 8/2004 Sembritzki et al.
2004/0209050 A1 10/2004 Andersson
2004/0231813 A1 11/2004 Basler et al.
2004/0247836 A1 12/2004 Biagiotti
2005/0067126 A1 3/2005 Horenziak et al.
2005/0092881 A1 5/2005 Schulz et al.
2005/0095400 A1 5/2005 Prodoehl

FOREIGN PATENT DOCUMENTS

DE 42 18 860 A1 9/1992
EP 1 044 807 10/2000
EP 1 312 466 A1 5/2003
EP 1 232 854 B1 4/2005
GB 2 377 674 A1 1/2003
WO WO 94/06623 3/1994
WO WO 98/50481 11/1998
WO WO 00/73053 12/2000
WO WO 03/031170 4/2003
WO WO 03/072344 9/2003
WO WO 2005/032320 A2 4/2005
WO WO 2005/080677 A2 9/2005

* cited by examiner

PROCESS FOR HIGH ENGAGEMENT EMBOSSING ON SUBSTRATE HAVING NON-UNIFORM STRETCH CHARACTERISTICS

CROSS REFERENCE TO RELATED APPLICATION

This application is a continuation-in-part of prior U.S. application Ser. No. 11/222,701, now U.S. Pat. No. 7,597,777 filed on Sep. 9, 2005.

FIELD OF THE INVENTION

The present invention relates to a process for deep embossing a web material that has non-uniform stretch characteristics with an emboss pattern that has more than one region of embossing protrusions where different regions create different line of stress directions, and still results in a uniform height of embossments across the web material.

BACKGROUND OF THE INVENTION

The embossing of webs, such as paper webs, is well known in the art. Embossing of webs can provide improvements to the web such as increased bulk, improved water holding capacity, improved aesthetics and other benefits. Both single ply and multiple ply (or multi-ply) webs are known in the art and can be embossed. Multi-ply paper webs are webs that include at least two plies superimposed in face-to-face relationship to form a laminate.

During a typical embossing process, a web is fed through a nip formed between juxtaposed generally axially parallel rolls or cylinders. Embossing protrusions on the rolls compress and/or deform the web. If a multi-ply product is being formed, two or more plies are fed through the nip and regions of each ply are brought into a contacting relationship with the opposing ply. The embossed regions of the plies may produce an aesthetic pattern and provide a means for joining and maintaining the plies in face-to-face contacting relationship.

Embossing is typically performed by one of two processes; knob-to-knob embossing or nested embossing. Knob-to-knob embossing typically consists of generally axially parallel rolls juxtaposed to form a nip within which the embossing protrusions, or knobs, on opposing rolls are aligned to press the web between the faces of the aligned protrusions. Nested embossing typically consists of embossing protrusions of one roll meshed in between the embossing protrusions of the other roll. Examples of knob-to-knob embossing and nested embossing are illustrated in the prior art by U.S. Pat. Nos. 3,414,459 issued Dec. 3, 1968 to Wells; 3,547,723 issued Dec. 15, 1970 to Gresham; 3,556,907 issued Jan. 19, 1971 to Nystrand; 3,708,366 issued Jan. 2, 1973 to Donnelly; 3,738,905 issued Jun. 12, 1973 to Thomas; 3,867,225 issued Feb. 18, 1975 to Nystrand; 4,483,728 issued Nov. 20, 1984 to Bauernfeind; 5,468,323 issued Nov. 21, 1995 to McNeil; 6,086,715 issued Jun. 11, 2000 to McNeil; 6,277,466 Aug. 21, 2001; 6,395,133 issued May 28, 2002 and 6,846,172 B2 issued to Vaughn et al. on Jan. 25, 2005.

Knob-to-knob embossing generally produces a web comprising very compressed areas and surrounding pillowed regions which can enhance the thickness of the product. However, the pillows have a tendency to collapse under pressure due to lack of support. Consequently, the thickness benefit is typically lost during the balance of the converting operation and subsequent packaging, diminishing the quilted appearance and/or thickness benefit sought by the embossing.

Nested embossing has proven in some cases to be a more desirable process for producing products exhibiting a softer, more quilted appearance that can be maintained throughout the balance of the converting process, including packaging. As the two plies travel through the nip of the embossing rolls, the patterns are meshed together. Nested embossing aligns the knob crests on the male embossing roll with the low areas on the female embossing roll. As a result, the embossed sites produced on one side of the structure provide support for the uncontacted side of the structure and the structure between embossment sites.

Another type of embossing, deep-nested embossing, has been developed and used to provide unique characteristics to the embossed web. Deep-nested embossing refers to embossing that utilizes paired emboss rolls, wherein the protrusions from the different emboss rolls are coordinated such that the protrusions of one roll fit into the spaces between the protrusions of the other emboss roll. Exemplary deep-nested embossing techniques are described in U.S. Pat. Nos. 5,686,168 issued to Laurent et al. on Nov. 11, 1997; 5,294,475 issued to McNeil on Mar. 15, 1994; U.S. patent application Ser. No. 11/059,986; U.S. patent application Ser. No. 10/700,131 and U.S. Patent Provisional Application Ser. No. 60/573,727.

While these deep-nested technologies have been useful, it has been observed that when producing certain deep-nested embossed patterns on substrates that have non-uniform stretch characteristics, the height and rigidity of the resulting embossments in the web material may vary when the emboss pattern has multiple lines of stress. This results in inconsistent emboss quality where some regions of the emboss pattern are diminished when contrasted to other regions in the pattern.

Accordingly, it would be desirable to provide a deep-nested embossing apparatus and/or process that provides at least some of the benefits of the prior art deep-nested embossing methods uniformly across differentiated emboss regions on a web substrate having such non-uniform stretch characteristics.

SUMMARY OF THE INVENTION

The present invention provides a process for producing a deep-nested embossed paper product comprising the steps of delivering one or more plies of paper to an embossing apparatus and embossing the one or more plies of the paper between two opposed embossing cylinders. The one or more plies of paper have a first direction and a second direction that is perpendicular to the first direction where both the first and second directions are in the plane of the paper. The one or more plies of paper have a stretch characteristic in the first direction that is higher than the stretch characteristic in the second direction. Each of the embossing cylinders have a plurality of protrusions, each of which have a height, where the embossing protrusions are disposed in an overall non-random pattern where the respective overall non-random patterns on the cylinders are coordinated to each other. The two embossing cylinders are aligned such that the respective coordinated overall non-random patterns of embossing protrusions nest together such that the protrusions engage each other to a depth of greater than about 1.016 mm.

The overall non-random pattern of protrusions comprises a plurality of emboss regions where each of the emboss regions comprise a fraction of the total number of protrusions in the overall non-random pattern. All of the protrusions within an embossing region have about the same height and the pattern of protrusions within an emboss region creates a localized primary line of stress on the paper as the plies of paper are embossed. The respective lines of stress each have a vector component in the first direction and a component in the second direction. The height of the protrusions are greater within an embossing region having a higher line of stress component in the first direction than the height of the protrusions in an embossing region having a lower line of stress component in the first direction.

The present invention further provides a web material, comprising one or more plies of a fibrous structure, the material having a first direction and a second direction which is perpendicular to the first direction and both first and second directions are in the plane of the web material, where the web material has different stretch characteristics in the first and second directions. The web material is embossed with a non-random pattern of embossments having an emboss height of greater than about 600 microns and having a height range of no greater than about 100 microns. The non-random pattern comprises a plurality of emboss regions where the pattern of embossments within an emboss region creates a localized primary line of stress on the paper as the web material is embossed and the plurality of emboss regions create primary lines of stress in more than one direction.

DETAILED DESCRIPTION OF THE INVENTION

Figure 1:
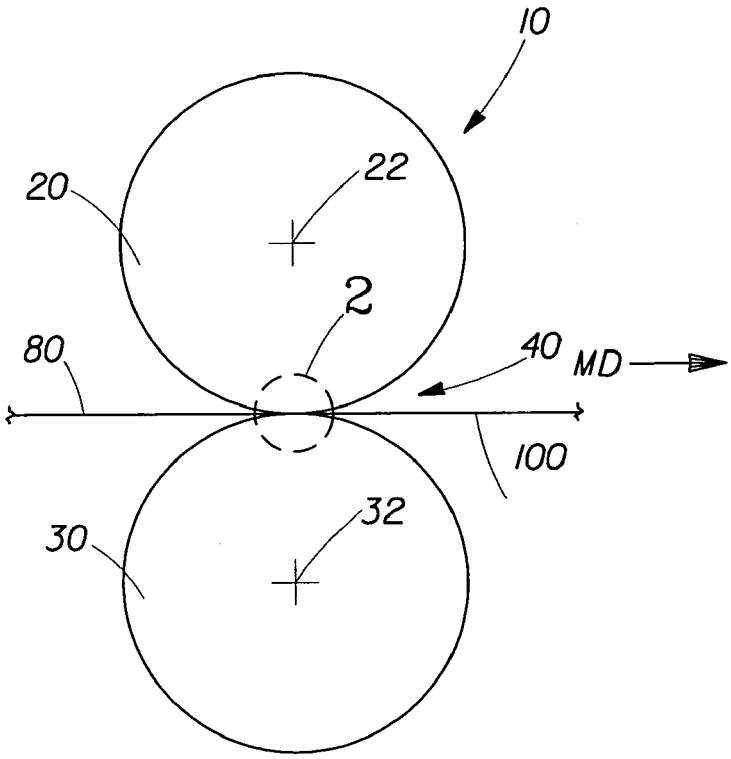
FIG. 1 is a schematic side view of one embodiment of an apparatus that can be used to perform the deep-nested embossing of the present invention.

The present invention relates to embossing a web with differential stretch characteristics. The web is embossed with a pattern with distinct regions having different lines of stress from the embossing. The invention specifically relates to a process for producing a deep-nested embossed paper product comprising the steps of delivering one or more plies of paper, that have non-uniform stretch characteristics, to an embossing apparatus, and embossing the one or more plies of the paper with a pattern having discrete regions having different lines of stress. The embossing rolls have protrusions, also known as knobs, in a non-random overall pattern, having greater heights in the regions of the overall pattern where the localized primary line of stress aligns more with a higher stretch character than in regions where the localized primary line of stress aligns more with the lower stretch character of the product.

As used herein "paper product" refers to any formed, fibrous structure products, traditionally, but not necessarily comprising cellulose fibers. In one embodiment the paper products of the present invention include tissue-towel paper products.

A "tissue-towel paper product" refers to creped and/or uncreped products comprising paper tissue or paper towel technology in general, including, but not limited to, conventional felt-pressed or conventional wet-pressed tissue paper, pattern densified tissue paper, starch substrates, and high bulk, uncompacted tissue paper. Non-limiting examples of tissue-towel paper products include toweling, facial tissue, bath tissue, table napkins, and the like.

The term "ply" means an individual sheet of fibrous structure. In one embodiment the ply has an end use as a tissue-towel paper product. A ply may comprise one or more wet-laid layers, air-laid layers, and/or combinations thereof. If more than one layer is used, it is not necessary for each layer to be made from the same fibrous structure. Further, the layers may or may not be homogenous within a layer. The actual makeup of a tissue paper ply is generally determined by the desired benefits of the final tissue-towel paper product, as would be known to one of skill in the art.

The ply has a first direction D1 and a second direction D2, where both the first and second directions are in the plane of the ply and the first and second directions are perpendicular to each other. The deep-nested embossed paper product has a third direction perpendicular to both of the first and second directions along which the height of the embossment is measured. In some embodiments the first and second directions coincide with the machine direction and the cross-machine direction of the web material.

The term "machine direction" (MD) refers to the dimension of a web material that is parallel to the direction of travel. "Cross-machine direction" (CD) refers to the dimension of a web material that is coplanar with the MD but perpendicular thereto. The "z-direction" refers to the dimension of a web material that is perpendicular to both the MD and CD. In one embodiment of the present invention the first direction of the present invention aligns with the machine direction, thereby providing a situation where the stretch in the machine direction, "MD stretch", is greater than the stretch in the cross-machine direction, "CD stretch". In another embodiment of the present invention, the first direction of the present invention aligns with the cross-machine direction, thereby providing a situation where the stretch in the cross-machine direction, "CD stretch", is greater than the stretch in the machine direction.

The term "fibrous structure" as used herein means an arrangement of fibers produced in any papermaking machine known in the art to create a ply of paper. "Fiber" means an elongate particulate having an apparent length greatly exceeding its apparent width. More specifically, and as used herein, fiber refers to such fibers suitable for a papermaking process. The present invention contemplates the use of a variety of paper making fibers, such as, natural fibers, synthetic fibers, as well as any other suitable fibers, starches, and combinations thereof. Paper making fibers useful in the present invention include cellulosic fibers commonly known as wood pulp fibers. Applicable wood pulps include chemical pulps, such as Kraft, sulfite and sulfate pulps, as well as mechanical pulps including, groundwood, thermomechanical pulp, chemically modified, and the like. Chemical pulps, however, may be useful in tissue towel embodiments since they are known to those of skill in the art to impart a superior tactical sense of softness to tissue sheets made therefrom. Pulps derived from deciduous trees (hardwood) and/or coniferous trees (softwood) can be utilized herein. Such hardwood and softwood fibers can be blended or deposited in layers to provide a stratified web. Exemplary layering embodiments and processes of layering are disclosed in U.S. Pat. Nos. 3,994,771 and 4,300,981. Additionally, fibers derived from wood pulp such as cotton linters, bagesse, and the like, can be used. Additionally, fibers derived from recycled paper, which may contain any of all of the categories as well as other non-fibrous materials such as fillers and adhesives used to manufacture the original paper product may be used in the present web. In addition, fibers and/or filaments made from polymers, specifically hydroxyl polymers, may be used in the present invention. Non-limiting examples of suitable hydroxyl polymers include polyvinyl alcohol, starch, starch derivatives, chitosan, chitosan derivatives, cellulose derivatives, gums, arabinans, galactans, and combinations thereof. Additionally, other synthetic fibers such as rayon, polyethylene, and polypropylene fibers can be used within the scope of the present invention. Further, such fibers may be latex bonded. Other materials are also intended to be within the scope of the present invention as long as they do not interfere or counter act any advantage presented by the instant invention.

As would be known to one of skill in the art, surfactants may be used to treat tissue paper embodiments of the webs if enhanced absorbency is required. In one embodiment, surfactants can be used at a level ranging from about 0.01% to about 2.0% by weight based on the dry fiber weight of the tissue web. In one embodiment surfactants have alkyl chains having at-least 8 carbon atoms. Exemplary anionic surfactants include, but are not limited to, linear alkyl sulfonates and alkylbenzene sulfonates. Exemplary, but non-limiting nonionic surfactants include alkylglycosides, esters therefrom, and alkylpolyethoxylated esters. Further, as would be known to one of skill in the art, cationic softener active ingredients with a high degree of unsaturated (mono and/or poly) and/or branched chain alkyl groups can enhance absorbency.

It is also intended that other chemical softening agents may be used in accordance with the present invention. Chemical softening agents may comprise quaternary ammonium compounds such as dialkyldimethylammonium salts, mono- or di-ester variations therefrom, and organo-reactive polydimethyl siloxane ingredients such as amino functional polydimethyl siloxane.

It is also intended that the present invention may incorporate the use of at least one or more plies of non-woven webs comprising synthetic fibers. Such exemplary substrates include textiles, other non-woven substrates, latex bonded web substrates, paper-like products comprising synthetic or multi-component fibers, and combinations thereof. Exemplary alternative substrates are disclosed in U.S. Pat. Nos. 4,609,518 and 4,629,643; and European Patent Application EP A 112 654.

A tissue-towel paper product substrate may comprise any tissue-towel paper product known in the industry and to those of skill in the art. Exemplary substrates are disclosed in U.S. Pat. Nos. 4,191,609; 4,300,981; 4,514,345; 4,528,239; 4,529,480; 4,637,859; 5,245,025; 5,275,700; 5,328,565; 5,334,289; 5,364,504; 5,411,636; 5,527,428; 5,556,509; 5,628,876; 5,629,052; and 5,637,194.

In one embodiment tissue-towel product substrates may be through air dried or conventionally dried. Optionally, a preferred tissue-towel product substrate may be foreshortened by creping or wet micro-contraction. Exemplary creping and/or wet-micro contraction processes are disclosed in U.S. Pat. Nos. 4,191,756; 4,440,597; 5,865,950; 5,942,085; and 6,048,938.

Further, conventionally pressed tissue paper and methods for making such paper are known in the art. In one embodiment the tissue paper is pattern densified tissue paper that is characterized by having a relatively high bulk field of relatively low fiber density and an array of densified zones of relatively high fiber density. The high bulk field is alternatively characterized as a field of pillow regions. The densified zones are alternatively referred to as knuckle regions. The densified zones may be discretely spaced within the high bulk field or maybe interconnected, either fully or partially, within the high bulk field. Exemplary processes for producing pattern densified tissue webs are disclosed in U.S. Pat. Nos. 3,301,746; 3,473,576; 3,573,164; 3,821,068; 3,974,025; 4,191,609; 4,239,065; 4,528,239; and 4,637,859.

As used herein, the phrase "stretch" is a measured characteristic that reflects the degree or percent of elongation the web exhibits when put under a tensile force in a specific direction. Stretch is measured by the % Elongation test defined in the Test Methods section herein. If the process of the present invention is used to emboss a web comprising more than one ply, the stretch of that web is determined by measuring the combined web to determine the overall stretch characteristics.

An exemplary process for embossing a web substrate in accordance with the present invention incorporates the use of a deep-nested embossment technology. By way of a non-limiting example, a tissue ply structure is embossed in a gap between two embossing rolls. The embossing rolls may be made from any material known for making such rolls, including, without limitation, steel, rubber, elastomeric materials, and combinations thereof. As known to those of skill in the art, each embossing roll may be provided with a combination of emboss protrusions and gaps. Each emboss protrusion comprises a base, a face, and one or more sidewalls. Each emboss protrusion also has a height, h. The height of the emboss protrusions may range from about 1.8 mm. (0.070 in.) to about 3.8 mm. (0.150 in.), in one embodiment from about 2.0 mm. (0.080 in.) to about 3.3 mm. (0.130 in.).

FIG. 1 shows one embodiment of the apparatus 10 of the present invention. The apparatus 10 includes a pair of rolls, first embossing roll 20 and second embossing roll 30. (It should be noted that the embodiments shown in the figures are just exemplary embodiments and other embodiments are certainly contemplated. For example, the embossing rolls 20 and 30 of the embodiment shown in FIG. 1 could be replaced with any other embossing members such as, for example, plates, cylinders or other equipment suitable for embossing webs. Further, additional equipment and steps that are not specifically described herein may be added to the apparatus and/or process of the present invention.) The embossing rolls 20 and 30 are disposed adjacent each other to provide a nip 40. The rolls 20 and 30 are generally configured so as to be rotatable on an axis, the axes 22 and 32, respectively, of the rolls 20 and 30 are typically generally parallel to one another. The apparatus 10 may be contained within a typical embossing device housing. As shown in FIG. 1, the first and second embossing rolls 20 and 30 provide a nip 40 through which a web 100 can pass. In the embodiment shown, the web 100 is made up of a single ply and is shown passing through the nip 40 in the machine direction MD.

Figure 2:
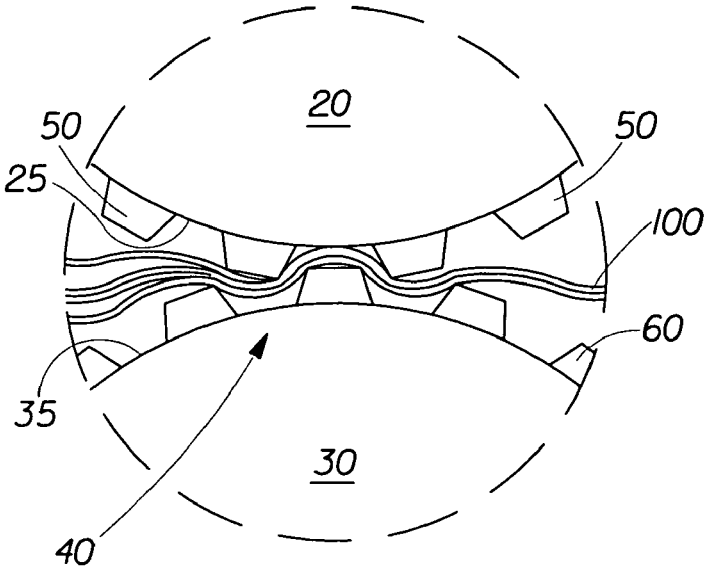
FIG. 2 is an enlarged side view of the nip formed between the embossing rolls of the apparatus shown in FIG. 1.

FIG. 2 is an enlarged view of the portion of the apparatus 10 labeled 2 in FIG. 1. The figure shows a more detailed view of the web 100 passing through the nip 40 between the first embossing roll 20 and the second embossing roll 30. As can be seen in FIG. 2, the first embossing roll 20 includes a plurality of first embossing protrusions 50 extending from the outer surface 25 of the first embossing roll 20. The second embossing roll also includes a plurality of second embossing protrusions 60 extending outwardly from the outer surface 35 of the second embossing roll 30. The first embossing protrusions 50 and the second embossing protrusions 60 are generally arranged in a non-random pattern. (It should be noted that when the embossing protrusions 50 and/or 60 are described as extending from an outer surface of an embossing roll, the embossing protrusions may be integral with the surface of the embossing roll or may be separate protrusions that are joined to the surface of the embossing roll.) As the ply of the web 80 or web 100 is passed through the nip 40, it is nested and macroscopically deformed by the intermeshing of the first embossing protrusions 50 and the second embossing protrusions 60. The embossing shown is deep-nested embossing, as described herein, because the first embossing protrusions 50 and the second embossing protrusions 60 intermesh with each other, for example like the teeth of gears. Thus, the resulting web 100 is deeply embossed and nested, as will be described in more detail below, and includes plurality of undulations that can add bulk and caliper to the web 100.

The embossing rolls 20 and 30, including the outer surfaces of the rolls 25 and 35 as well as the embossing protrusions 50 and 60, may be made out of any material suitable for the desired embossing process. Such materials include, without limitation, steel and other metals, ebonite, and hard rubber or a combination thereof.

Figure 3:
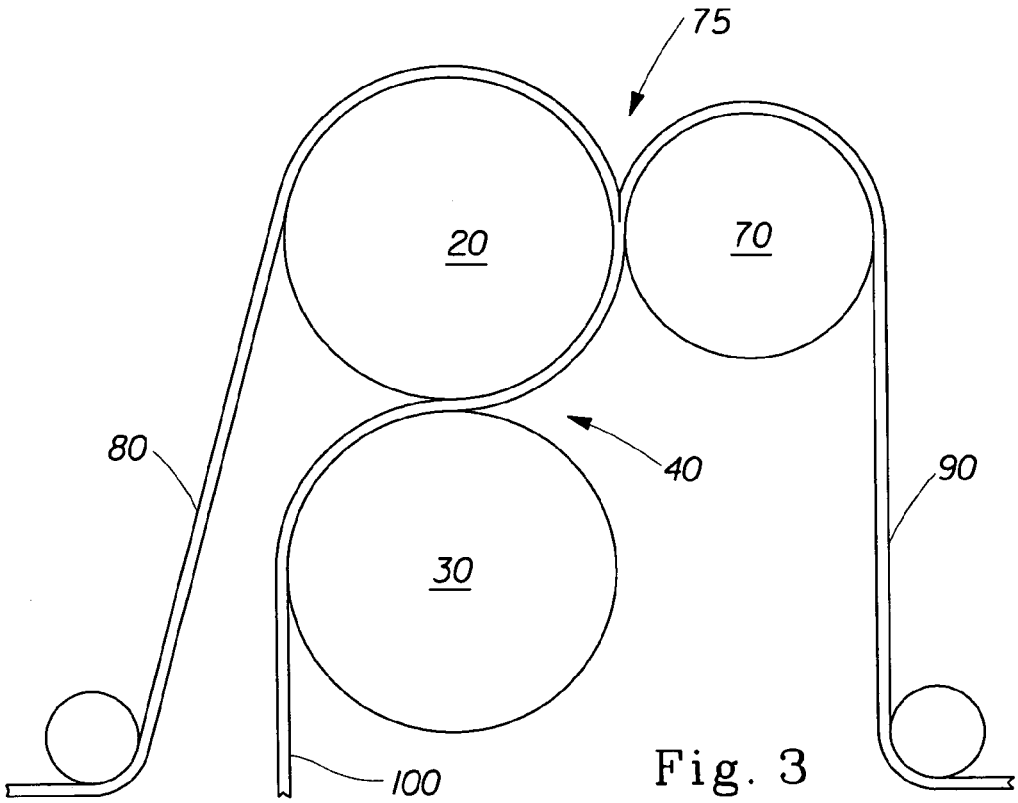
FIG. 3 is a schematic side view of one embodiment of an apparatus that can be used to perform the deep-nested embossing of the present invention.

While the apparatus shown in FIG. 1 may be used for webs having one ply, the apparatus may be used to make multi-ply products as well. FIG. 3 shows an embodiment to the process of the present invention where a two ply product is produced where both plies are embossed. The first ply 80 and the second ply 90 of resulting web 100 are first joined together between marrying roll 70 and the first embossing roll 20. The first and second plies 80 and 90 can be joined together by any known means, but typically an adhesive application system is used to apply adhesive to one or both of the first and second plies 80 and 90 prior to the plies being passed between the nip 75 formed between the marrying roll 70 and the first embossing roll 20. The resulting web 100 is then passed through the nip 40 formed between the first embossing roll 20 and the second embossing roll 30 where it is embossed.

Figure 4:
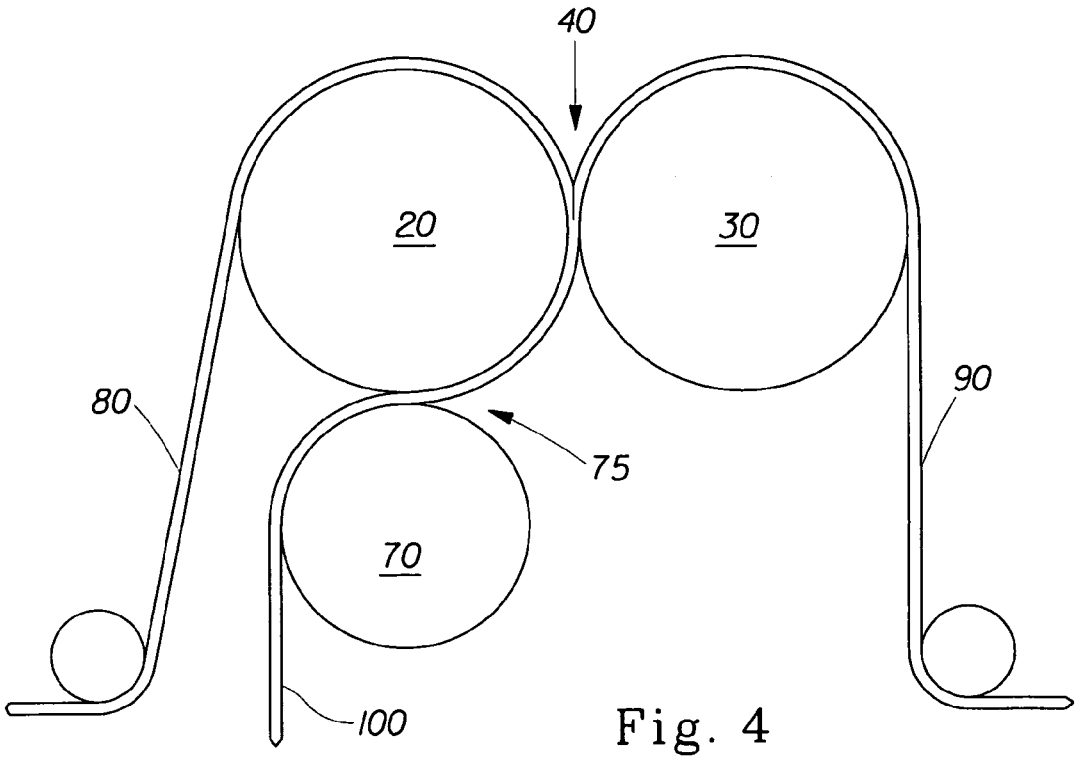
FIG. 4 is a schematic side view of an alternative apparatus that can be used to perform the deep-nested embossing of the present invention.

In yet another possible embodiment of the present invention to produce multi-ply products, as shown in FIG. 4, the plies first and second 80 and 90 are passed through the nip 40 formed between the first embossing roll 20 and the second embossing roll 30 where the plies are placed into contact with each other and embossed. At this stage, it is also common to join the webs together using conventional joining methods such as an adhesive application system, but, as noted above, other joining methods can be used. The resulting web 100 is then passed through the nip 75 between the first embossing roll 20 and the marrying roll 70. This step is often used to ensure that the first and second plies 80 and 90 of the resulting web 100 are securely joined together before the resulting web 100 is directed to further processing steps or winding.

It should be noted that with respect to any of the methods described herein, the number of plies is not critical and can be varied, as desired. Thus, it is within the realm of the present invention to utilize methods and equipment that provide a final web product having a single ply, two plies, three plies, four plies or any other number of plies suitable for the desired end use. In each case, it is understood that one of skill in the art would know to add or remove the equipment necessary to provide and/or combine the different number of plies. Further, it should be noted that the plies of a multi-ply web product need not be the same in make-up or other characteristics. Thus, the different plies can be made from different materials, such as from different fibers, different combinations of fibers, natural and synthetic fibers or any other combination of materials making up the base plies. Further, the resulting web 100 may include one or more plies of a cellulosic web and/or one or more plies of a web made from non-cellulose materials including polymeric materials, starch based materials and any other natural or synthetic materials suitable for forming fibrous webs. In addition, one or more of the plies may include a nonwoven web, a woven web, a scrim, a film a foil or any other generally planar sheet-like material. Further, one or more of the plies can be embossed with a pattern that is different from one or more of the other plies or can have no embossments at all.

Figure 5:
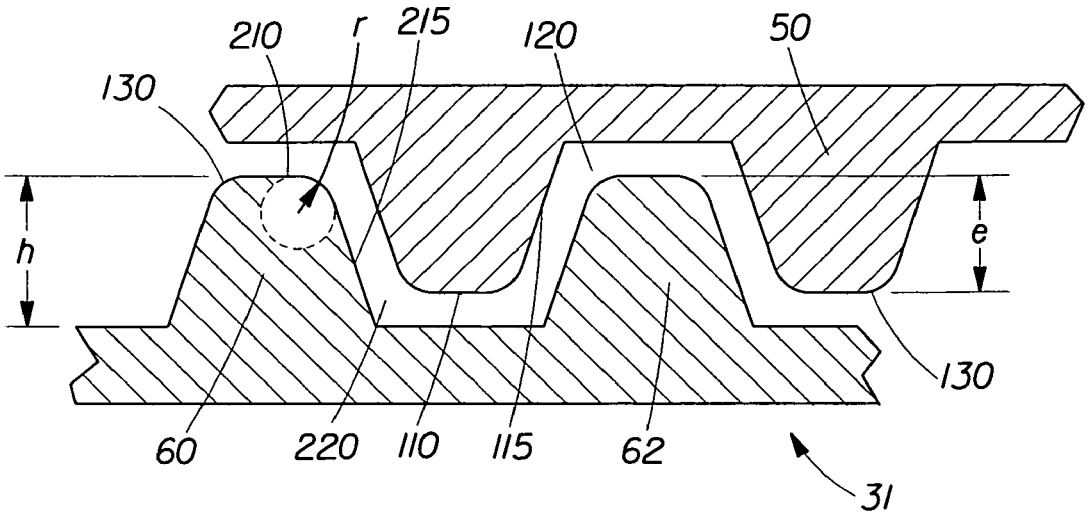
FIG. 5 is a side view of the gap between two engaged emboss cylinders of the apparatus for deep-nested embossing of the present invention.

In the deep-nested emboss process, one example of which is shown in FIG. 5, the first and second embossing protrusions 50 and 60 of the embossing rolls (in this case first embossing plate 21 and second embossing plate 31) engage such that the distal end 110 of the first embossing protrusions 50 extend into the space 220 between the second embossing protrusions 60 of the second embossing plate 30 beyond the distal end 210 of the second embossing protrusions 60. Accordingly, the distal ends 210 of the second embossing protrusions 60 should also extend into the space 120 between the first embossing protrusions 50 of the first embossing plate 20 beyond the distal end 110 of the first embossing protrusions 50. The depth of the engagement E may vary depending on the level of embossing desired on the final product and can be any distance greater than zero. Typical deep-nested embodiments have a engagement E greater than about 0.01 mm, greater than about 0.05 mm, greater than about 1.0 mm, greater than about 1.25 mm, greater than about 1.5 mm, greater than about 2.0 mm, greater than about 3.0 mm, greater than about 4.0 mm, greater than about 5.0 mm, between about 0.01 mm and about 5.0 mm or about 0.05 mm to about 2 mm, or any combination of these numbers to create ranges, or any number within this range. (It should be noted that although the description in this paragraph describes certain relationships between the first and second embossing protrusions 50 and 60 disposed on embossing members that are first and second embossing plates 21 and 31, the same engagement characteristics are applicable to first and second embossing protrusions 50 and 60 that are disposed on embossing members that are not plates, but rather take on a different form, such as, for example, the embossing rolls 20 and 30 shown in FIG. 1.)

In certain embodiments, as shown, for example, in FIG. 5, at least some of the first embossing protrusions 50 and/or the second embossing protrusions 60, whether they are linear or discrete, may have at least one transition region 130 between the face and the sidewalls of the protrusion that has a radius of curvature of curvature r. When a transition region is employed, the transition region 130 is disposed between the distal end of the embossing plate and the sidewall of the embossing plate. (As can be seen in FIG. 5, the distal end of the first embossing plate is labeled 110, while the sidewall of the first embossing plate is labeled 115. Similarly, the distal end of the second embossing plate is labeled 210, while one of the sidewalls of the second embossing plate is labeled 215.) The radius of curvature of curvature r is typically greater than about 0.075 mm. Other embodiments have radii of greater than 0.1 mm, greater than 0.25 mm, greater than about 0.5 mm, between about 0.075 mm and about 0.5 mm or any combination of these numbers to create ranges, or any number within this range. The radius of curvature of curvature r of any particular transition region is typically less than about 1.8 mm. Other embodiments may have embossing protrusions with transition regions 130 having radii of less than about 1.5 mm, less than about 1.0 mm, between about 1.0 mm and about 1.8 mm or any number within the range. (Although FIG. 5 shows an example of two intermeshing embossing plates, first embossing plate 21 and second embossing plate 31, the information set forth herein with respect to the first and second embossing protrusions 50 and 60 is applicable to any type of embossing platform or mechanism from which the embossing protrusions can extend, such as rolls, cylinders, plates and the like.)

The "rounding" of the transition region 130 typically results in a circular arc rounded transition region 130 from which a radius of curvature of curvature is determined as a traditional radius of curvature of the arc. The present invention, however, also contemplates transition region configurations which approximate an arc rounding by having the edge of the transition region 130 removed by one or more straight line or irregular cut lines. In such cases, the radius of curvature of curvature r is determined by measuring the radius of curvature of a circular arc that includes a portion which approximates the curve of the transition region 130.

In other embodiments, at least a portion of the distal end of one or more of the embossing protrusions other than the transition regions 130 can be generally non-planar, including for example, generally curved or rounded. Thus, the entire surface of the embossing element spanning between the sidewalls 115 or 215 can be non-planar, for example curved or rounded. The non-planar surface can take on any shape, including, but not limited to smooth curves or curves, as described above, that are actually a number of straight line or irregular cuts to provide the non-planar surface. One example of such an embossing element is the embossing element 62 shown in FIG. 5. Although not wishing to be bound by theory, it is believed that rounding the transition regions 130 or any portion of the distal ends of the embossing protrusions can provide the resulting paper with embossments that are more blunt with fewer rough edges. Thus, the resulting paper may be provided with a smoother and/or softer look and feel.

As would be known to one of skill in the art, the plurality of embossments of the one or more plies of fibrous structure or embossed tissue/towel paper product of the present invention could be configured in a non-random pattern of positive embossments and a corresponding non-random pattern of negative embossments. Further, such positive and negative embossments may be embodied in random patterns as well as combinations of random and non-random patterns. By convention, positive embossments are embossments that protrude toward the viewer when the embossed product is viewed from above the surface of the web. Conversely, negative embossments are embossments that appear to push away from the viewer when the embossed product is viewed from above a surface.

The embossed paper product of the present invention may comprise one or more plies of tissue/towel paper, in another embodiment two or more plies. In one embodiment at least one of the plies comprises a plurality of embossments. When the embossed paper product comprises two or more plies of tissue structure, the plies may be the same substrate respectively, or the plies may comprise different substrates combined to create any desired consumer benefit(s). Some embodiments of the present invention comprise two plies of tissue substrate. Another embodiment of the present invention comprises a first outer ply, a second outer ply, and at least one inner ply. Further, another embodiment of the present invention will have a total embossed area of less than or equal to about 20%, in another embodiment less than or equal to about 15%, in another embodiment less than or equal to about 10%, and in yet another embodiment less than or equal to about 8% or from about 2% to about 20%, in another embodiment from about 5% to about 15%, or any combination of these numbers to create ranges. Embossed area, as used herein, means the area of the paper structure that is directly contacted and compressed by either positive or negative embossing protrusions. Portions of the paper substrate that are deflected as a result of engagement between positive and negative embossment knobs are not considered part of the embossed area. Embossments are often based on standard plane geometry shapes such as circles, ovals, various quadrilaterals and the like, both alone and in combination. For such plane geometry figures, the area of an individual embossment can be readily derived from well known mathematical formulas. For more complex shapes, various area calculation methods may be used. One such technique follows. Start with an image of a single embossment at a known magnification of the original (for example 100×) on an otherwise clean sheet of paper, cardboard or the like. Calculate the area of the paper and weigh it. Cut out the image of the embossment and weigh it. With the known weight and size of the whole paper, and the known weight and magnification of the embossment image, the area of the actual embossment may be calculated as follows:

$$\text{embossment area}=((\text{embossment image weight}/\text{paper weight})\times\text{paper area})/\text{magnification}^2$$

The embossed product of the present invention may comprise only one ply of such a deep-nested, embossed substrate. Such an exemplary process can facilitate the combination of one ply that is deep-nested embossed and other non-embossed plies. Alternatively, at least two plies can be combined and then embossed together in such a deep-nested, embossing process. An exemplary embodiment of the latter combination provides an embossed tissue-towel paper comprising more than one ply where the first and second outer plies are deep-nested embossed and the resulting deep-nested and embossed plies are subsequently combined with one or more additional plies of the fibrous structure substrate.

The process of the present invention may also comprise the step of conditioning the one or more plies of paper. The conditioning step comprises heating the one or more plies of paper, adding moisture to the one or more plies of paper, or both heating and adding moisture to the one or more plies of paper. Examples of such conditioning steps are illustrated in co-pending U.S. patent application Ser. Nos. 11/147,697 and 11/147,698.

In one embodiment the embossing cylinders, rolls, plates, etc. of the embossing apparatus of the present invention each have a plurality of protrusions, or embossing knobs, which are disposed on the cylinder, etc. in an overall non-random pattern. The respective overall non-random patterns on the two embossing cylinders are coordinated to each other so the knobs of the set of cylinders nest in the embossing process. The overall non-random pattern of protrusions comprises two or more emboss regions, within the pattern, the emboss regions making up of a fraction of the total protrusions, each region having a different arrangement of protrusions. All of the protrusions within an emboss region have about the same height.

The specific arrangement of protrusions within one emboss region generally creates a localized primary line of stress. By "line of stress", it is meant the direction of the exertion of tension on the macrostructure of the fibrous structure of the web material as the web is being exposed to the positive and negative emboss knobs within the specific region during the embossing process. The fibrous structure is placed under stress in that direction more so than other directions by the deflection and deformation of the structure as the fibers are pulled over positive protrusions and pushed in an opposite direction, either directly or indirectly by the negative protrusions. By "localized", it is meant the primary line of stress exists within the emboss region in question. It is recognized that there may be multiple lines of stress within or proximate to the emboss region, but the "primary" line of stress considered in the present invention is the stress component with the highest tension or magnitude. If two or more lines of stress have equal stress or magnitude, the primary line of stress is the line having the greater component in the lower stretch direction as discussed below.

Lines of stress are imparted into the web material in an embossing process where the configuration of the match emboss knobs are such that the fiber structure is deformed over a greater linear distance in one direction than the others. This greater deformation, exerts more strain and as a result more stress in that direction than in the other directions.

Figure 7A:
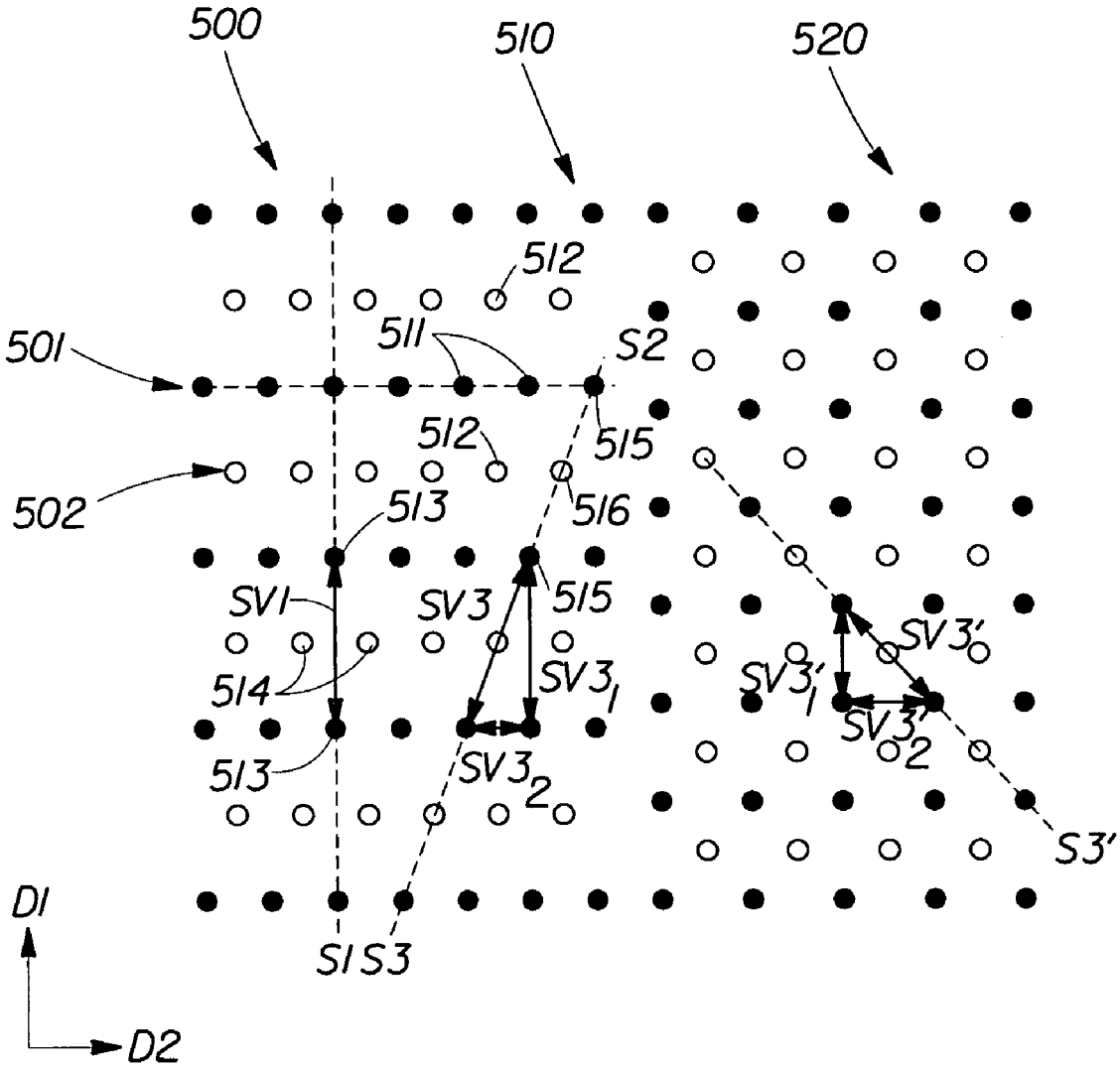
FIG. 7A is a top view of a portion of an emboss pattern that may be embossed on one embodiment of the paper products of the present invention.
Figure 7B:
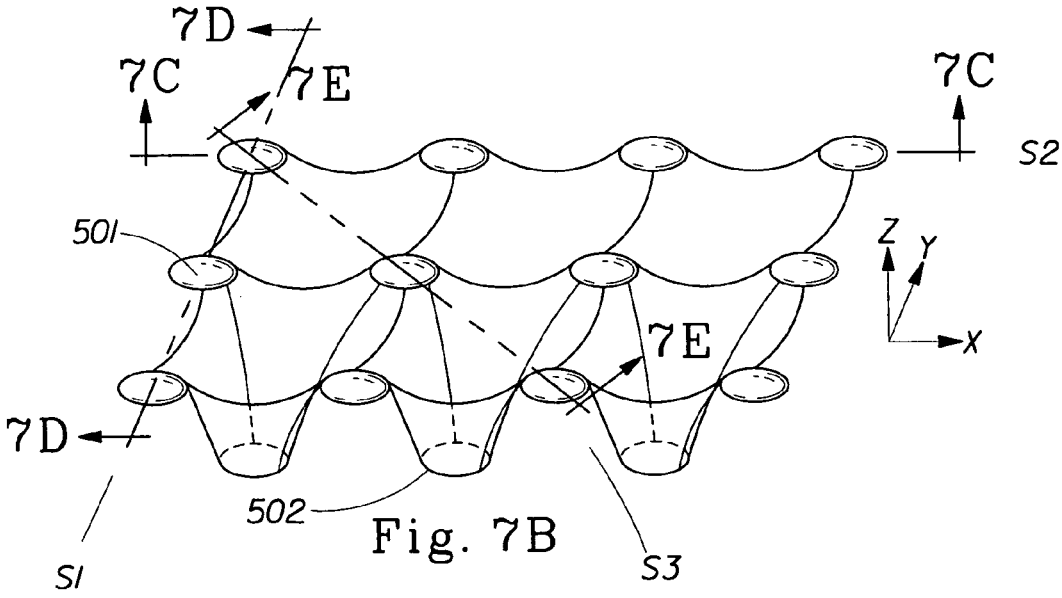
FIG. 7B is a plan view of the paper structure of FIG. 7A.
Figure 7C:
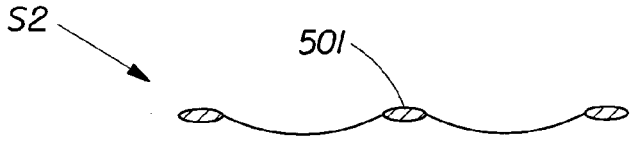
FIG. 7C is a cross-sectional view of the paper structure along the line of stress S1 in FIG. 7A.
Figure 7D:
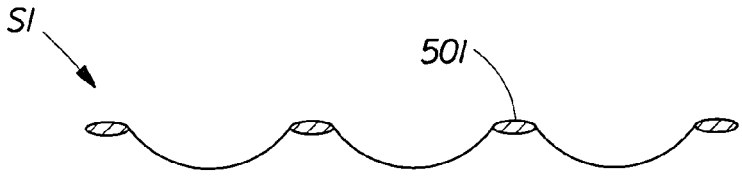
FIG. 7D is a cross-sectional view of the paper structure along the line of stress S2 in FIG. 7A.
Figure 7E:
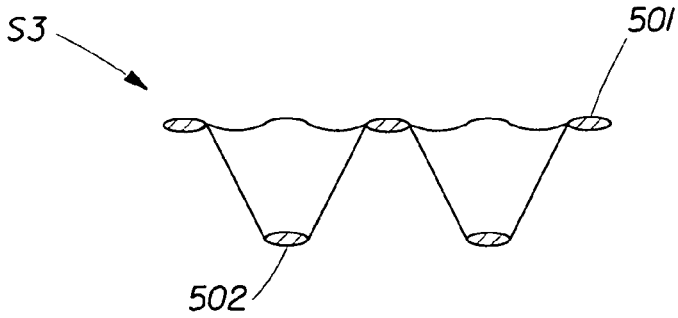
FIG. 7E is a cross-sectional view of the paper structure along the line of stress S3 in FIG. 7A.

FIGS. 7A and 7B shows a non-random overall embossing pattern 500 comprising a plurality of positive embossments 501 and negative embossments 502. The non-random pattern 500 comprises a first emboss region 510 and a second emboss region 520. The overall non-random emboss pattern 500 is shown in relation to the first and second directions D1 and D2 of the web material. As can be seen the overall non-random pattern of embossments depicted would result in at least 3 lines of stress S1, S2 and S3, where the fibrous structure is distorted around emboss knobs during the embossing process. The line of stress S1 would be formed by the structure bridging positive knobs 511 being pulled down by the pressure exerted by negative knobs 512 on either side of the bridging material forming the structure along S1 as shown in FIG. 7C. The line of stress S2 would be formed by the structure bridging positive knobs 513 being pulled down by the pressure exerted by negative knobs 514 on either side of the bridging material forming the structure along S2 as shown in FIG. 7D. The stress exerted in the line S2 would be greater because the negative knobs are closer to the bridging material and thereby exert more downward force on the structure. The line of stress S3 would be formed by the structure bridging the positive knobs 515 being directly deformed by the negative knob 516 forming the structure along S3 shown in FIG. 7E. The stress exerted in line S3 would be greater than either S1 or S2 because the structure is exposed to the greatest linear deformation by being pushed and pulled by both the negative and positive emboss knobs. Therefore in the first emboss region 510, line S3 would be the localized primary line of stress. Using a similar analysis, line S3' would be the primary line of stress in the second emboss region 520.

The lines of stress involved in the present application can be thought of in vector context where each primary line of stress can have a magnitude and directional components in relationship to the first and second directions of the web. For example, as shown in FIG. 7A the stress in the line of stress S3 and S3' can be represented by unit vectors SV3 and SV3' acting along the respective lines of stress. By a unit vector it is meant a vector in the direction along the line of stress with a commonly assigned magnitude, generally one. This is done because the directional components are determined and compared without a consideration of the magnitude of the stress. The unit vector SV3 can be divided into its components $SV3_1$ and $VS3_2$ in the first and second directions D1 and D2. Similarly, the unit vector SV3' can be divided into components $SV3'_1$ and $SV3'_2$. As can be seen in the specific illustration of FIG. 7A, that the unit vector SV3 in region 510 has a greater component in the direction of D1 and than the vector SV3' in region 520 has a greater component in the direction of D2.

It has been found that typically, when a web material that has different stretch characteristics in different directions, it is difficult to uniformly emboss. It has been observed that when a uniform embossing process (i.e. uniform emboss protrusion geometry and nip characteristics) is applied to such a web being embossed with distinct emboss regions having different localized primary lines of stress, the resulting embossed product is such that the embossments in the final product in the regions having a primary line of stress more in a direction with the higher stretch characteristics of the paper are less defined and visible than embossments in a region having a localized primary line of stress more in the direction of the lower stress direction of the web. As a result of this non-uniformity, the final embossed material has inconsistent looking embossments across the various regions of the overall non-random emboss pattern.

Further, when this emboss definition problem is attempted to be resolved by increasing the engagement of the emboss protrusions on the cylinders, such that the region having a primary line of stress in the higher stretch direction has an acceptably defined emboss structure, the regions having primary lines of stress in the lower stretch direction often are deformed to where the fibrous structure is destroyed by tearing of the structure.

The process of the present invention allows for the production of a deep-nested embossed product having a uniform embossment structure even though the material has different stretch characteristics in different directions and the overall emboss pattern comprises regions of different primary lines of stress. The process comprises the embossing of the one or more plies of paper between two emboss cylinders where the heights of the emboss knobs on at least one of the cylinders are adjusted such that the knob heights in emboss regions having a localized primary line of stress having a higher component in the high stretch direction are greater than the knob heights in emboss regions having a primary line of stress having a lower component in the lower stretch direction.

The process of the present invention produces a web material, comprising one of more plies of fibrous structure having different stretch characteristics in two perpendicular directions, where the emboss height is substantially uniform, despite the fact that the overall pattern of emboss protrusions has distinct emboss regions exposing the web to different primary lines of stress during the embossing process.

Under traditional embossing conditions, if the web embossed with the pattern of FIG. 7A has non-uniform stretch characteristics (e.g., the stretch in D1 is two times the stretch in D2), the emboss structures would be non-uniform. Without being limited by theory, it is believed that since the primary line of stress in region 510 has a larger component in the direction of higher material stretch than the line of stress in region 520, the work done on the fibrous structure in region 510 may not move the structure into as much plastic embossing as the work done on the structure in region 520. As a result, the embossing in region 510 will not be as permanent as the embossing in region 520. Alternatively, if the overall engagement of embossing cylinders is increased in order to increase the strength of the region 510 emboss structure, then the embossing process in region 520, where the primary line of stress is in a lower stretch direction, may result in tearing or other deterioration of the fibrous structure.

By the process of the present invention, this structure non-uniformity is resolved by increasing the height of the emboss protrusions on one or both of the cylinders in the regions where the primary line of stress is has a greater component in the direction of higher stretch. In the example presented in FIG. 7A, by the process of the present invention, the height of the protrusions in region 510 would be increased on one or both of the emboss cylinders.

Figure 8:
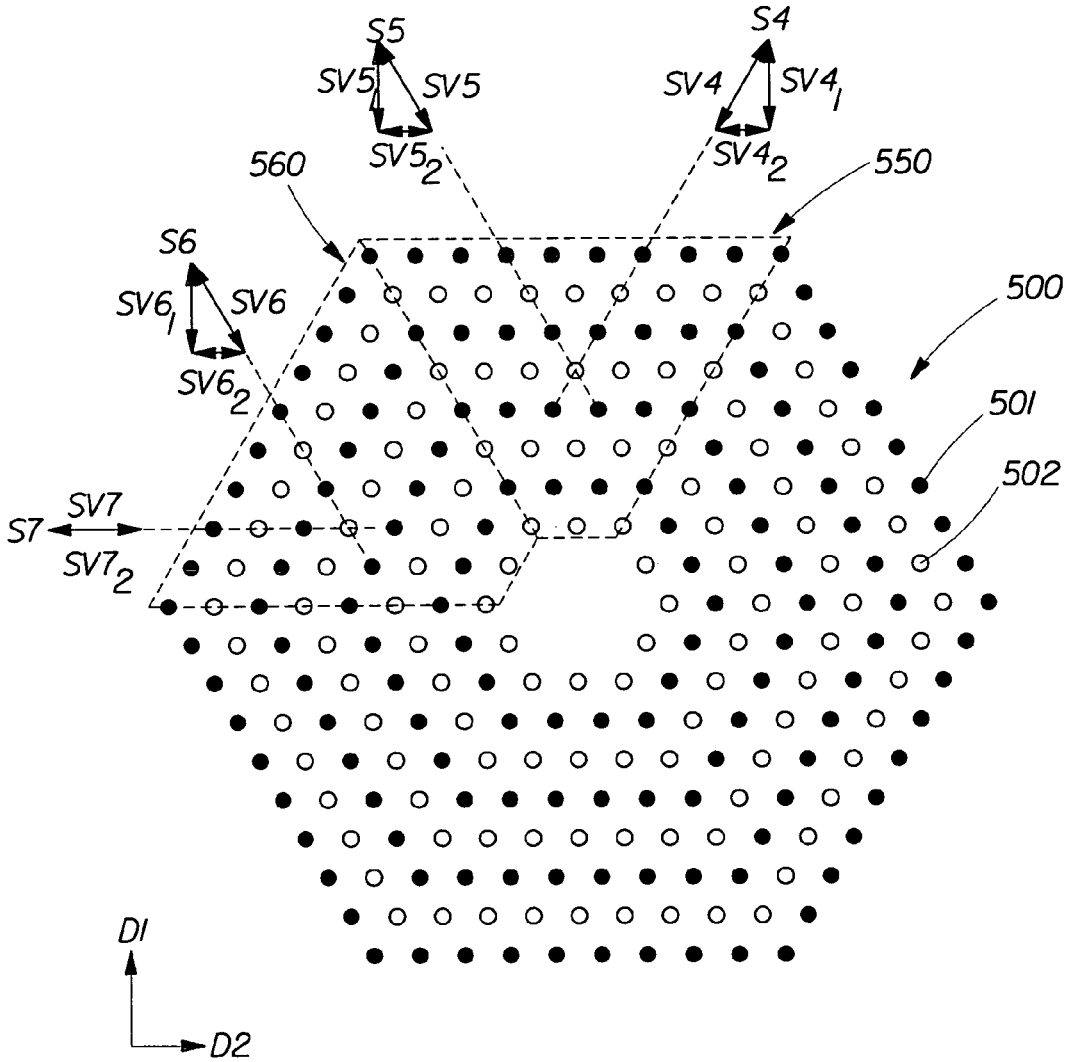
FIG. 8 is a top view of another emboss pattern that may be embossed on another embodiment of the paper product of the present invention.

Another example of the application of the process of the present invention to an overall pattern having more than one localized primary lines of stress is shown in FIG. 8. FIG. 8 shows an overall non-random embossing pattern comprising positive embossing protrusions 501 and negative embossing protrusions 502, where the overall pattern comprises multiple emboss regions, including regions 550 and 560, having different localized primary lines of stress. In region 550 there are two equivalent lines of stress S4 and S5 having the same components in the D1 and D2 directions. Region 560 also has two equal lines of stress S6 and S7. However, while S6 has the same components as S4 and S5 from region 550, S7 only has a component in the D2 direction. Therefore, if the web material has a higher stretch value in the D1 direction than in the D2, the localized primary line of stress is S7. Therefore, the process of the present invention would emboss the web material by supplying the web to an embossing apparatus having emboss protrusion on one or both of the cylinders in emboss region 550 with a greater height than the emboss protrusions of emboss regions 560.

Figure 6:
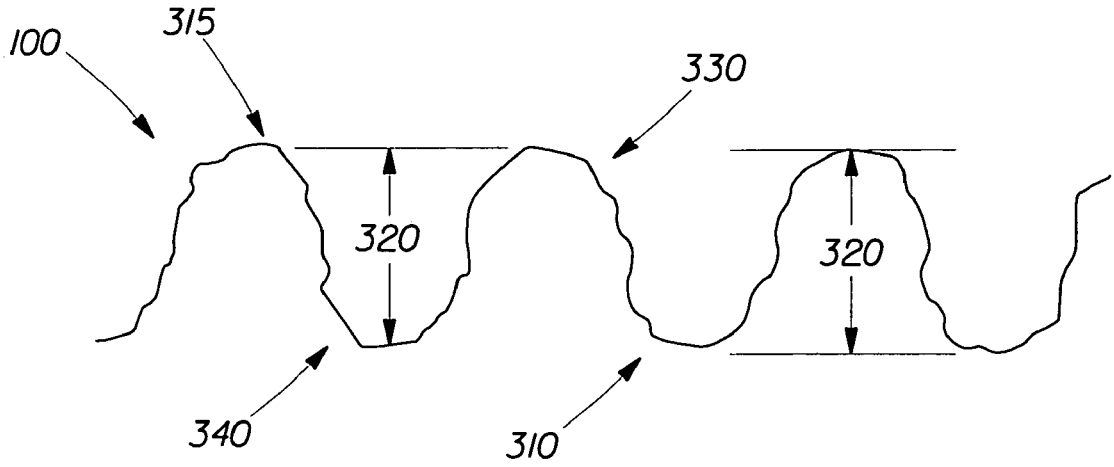
FIG. 6 is a side view of an embodiment of the embossed paper product produced by the apparatus or process of the present invention.

One example of an embossed web product is shown in FIG. 6. The embossed web product 100 comprises one or more plies, wherein at least one of the plies comprises a plurality of discrete embossments 310 and a plurality of linear embossments 315. (Generally, the embossments take on a shape that is similar to the embossing protrusions used to form the embossments, thus, for the purposes of this application, the shapes and sizes of the embossing protrusions described herein can also be used to describe suitable embossments. However, it should be noted that the shape of the embossments may not correspond exactly to the shape of any particular embossing element or pattern of embossing protrusions and thus, embossments of shapes and sizes different than those described herein with regard to the embossing protrusions are contemplated.) The ply or plies which are embossed are embossed in a deep-nested embossing process such that the embossments exhibit an embossment height h of at least about 650 μm, at least about 1000 μm, at least about 1250 μm, at least about 1450 μm, at least about 1550 μm, at least about 1800 μm, between about 650 μm and about 1800 μm, at least about 2000 μm, at least about 3000 μm, at least about 4000 μm, between about 650 μm and about 4000 μm or any combination of these numbers to create ranges, or any individual number within this range. The embossment height h of the embossed product 100 is measured by the Embossment Height Test method set forth below.

EXAMPLES

Example 1

One fibrous structure useful in achieving the embossed paper product of the present invention is the through-air-dried (TAD), differential density structure described in U.S. Pat. No. 4,528,239. Such a structure may be formed by the following process.

A Fourdrinier, through-air-dried papermaking machine is used in the practice of this invention. A slurry of papermaking fibers is pumped to the headbox at a consistency of about 0.15%. The slurry consists of about 55% Northern Softwood Kraft fibers, about 30% unrefined Eucalyptus fibers and about 15% repulped product broke. The fiber slurry contains a cationic polyamine-epichlorohydrin wet burst strength resin at a concentration of about 10.0 kg per metric ton of dry fiber, and carboxymethyl cellulose at a concentration of about 3.5 kg per metric ton of dry fiber.

Dewatering occurs through the Fourdrinier wire and is assisted by vacuum boxes. The wire is of a configuration having 41.7 machine direction and 42.5 cross direction filaments per cm, such as that available from Asten Johnson known as a "786 wire".

The embryonic wet web is transferred from the Fourdrinier wire at a fiber consistency of about 22% at the point of transfer, to a TAD carrier fabric. The wire speed is about 660 meters per minute. The carrier fabric speed is about 635 meters per minute. Since the wire speed is about 4% faster than the carrier fabric, wet shortening of the web occurs at the transfer point. Thus, the wet web foreshortening is about 4%. The sheet side of the carrier fabric consists of a continuous, patterned network of photopolymer resin, the pattern containing about 90 deflection conduits per inch. The deflection conduits are arranged in an amorphous configuration, and the polymer network covers about 25% of the surface area of the carrier fabric. The polymer resin is supported by and attached to a woven support member having of 27.6 machine direction and 11.8 cross direction filaments per cm. The photopolymer network rises about 0.43 mm above the support member.

The consistency of the web is about 65% after the action of the TAD dryers operating about a 254° C., before transfer onto the Yankee dryer. An aqueous solution of creping adhesive consisting of animal glue and polyvinyl alcohol is applied to the Yankee surface by spray applicators at a rate of about 0.66 kg per metric ton of production. The Yankee dryer is operated at a speed of about 635 meters per minute. The fiber consistency is increased to an estimated 95.5% before creping the web with a doctor blade. The doctor blade has a bevel angle of about 33 degrees and is positioned with respect to the Yankee dryer to provide an impact angle of about 87 degrees. The Yankee dryer is operated at about 157° C., and Yankee hoods are operated at about 120° C.

The dry, creped web is passed between two calendar rolls and rolled on a reel operated at 606 meters per minute so that there is about 9% foreshortening of the web by crepe; about 4% wet microcontraction and an additional 5% dry crepe. The resulting paper has a basis weight of about 23 grams per square meter (gsm) and has a MD stretch of about 21% and a CD stretch of about 9%.

Figure 9:
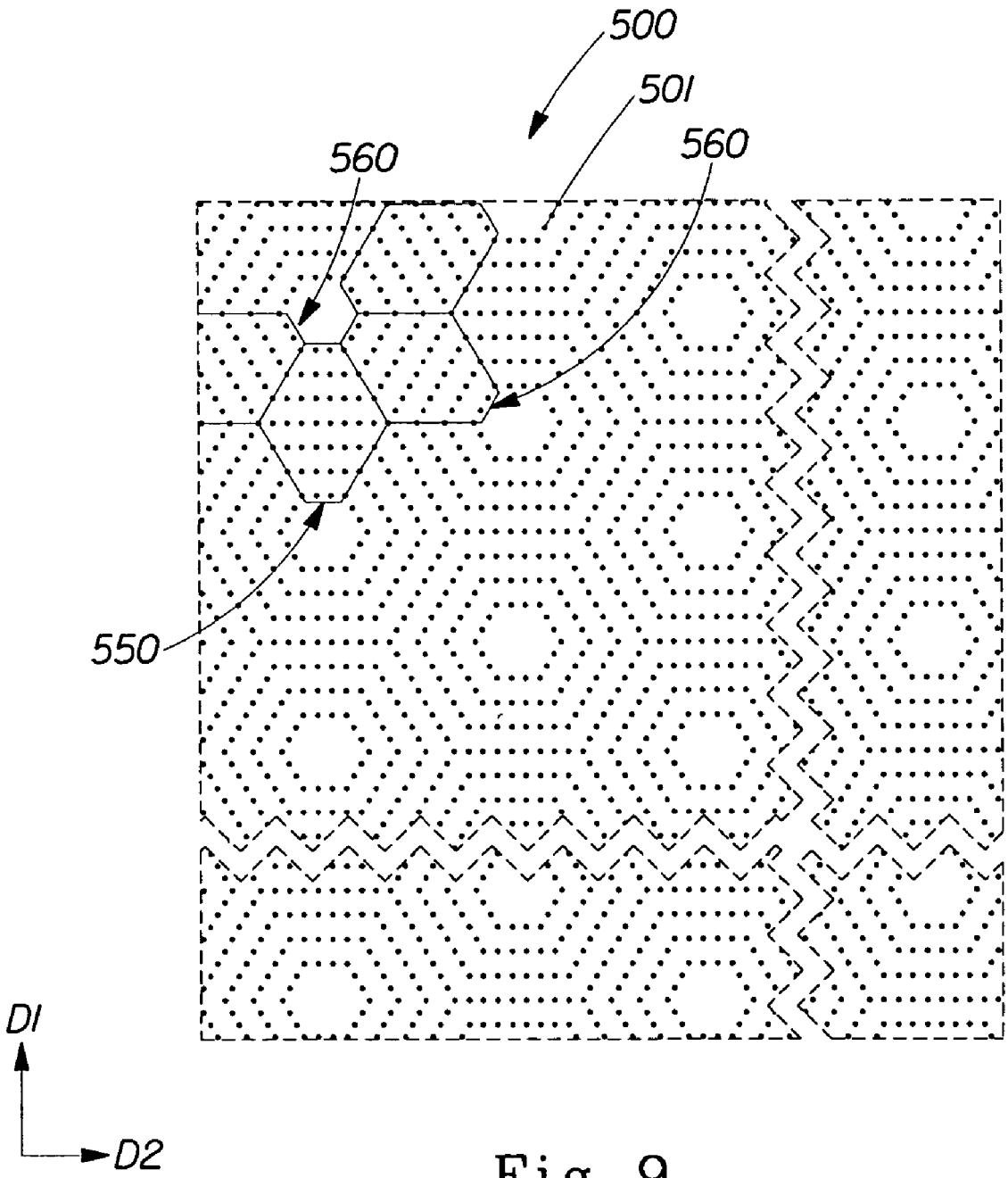
FIG. 9 is a representative pattern of the overall non-random pattern of only the positive emboss protrusions on one of the cylinders of the process of the present invention.

The paper described above is then subjected to the deep-nested embossing process of this invention. Two emboss rolls are engraved with complimentary, nesting embossing protrusions shown in FIGS. 1-6. The rolls are mounted in the apparatus with their respective axes being generally parallel to one another. The rolls are engraved such that the protrusions are in a non-random overall pattern having a multiple repeating pattern of the pattern shown in FIG. 8 as shown in FIG. 9, which has a multiple of emboss regions having different lines of stress as shown in FIG. 8. The discrete embossing protrusions are frustaconical in shape, with a face (top or distal—i.e. away from the roll from which they protrude) diameter of about 2.79 mm and a floor (bottom or proximal—i.e. closest to the surface of the roll from which they protrude) diameter of about 4.12 mm. The linear protrusions have a width similar to that of the discrete embossing protrusions of about 2.79 mm. The height of the embossing protrusions on each roll is about 2.845 mm in the emboss regions having the line of stress with a larger component in the machine direction (higher stretch) and the height of the protrusions is about 2.718 mm in the regions having the line of stress with a larger component in the cross-machine direction (lower stretch). The radius of curvature of the transition region of the embossing protrusions is about 0.76 mm. The planar projected area of each embossing pattern single pattern unit is about 25 cm. The engagement of the nested rolls is set to about 2.286 mm in the emboss regions having the line of stress with a larger component in the machine direction (higher stretch) and the engagement of the protrusions is about 2.159 mm in the regions having the line of stress with a larger component in the cross-machine direction (lower stretch). The paper described above is fed through the engaged gap at a speed between 300 and 400 meters per minute. The resulting paper has an embossment height of greater than about 1000 μm.

Example 2

In another embodiment of the embossed paper products of the present invention, the deep nested embossing process of Example 1 is modified such that the paper of Example 1 is conditioned with steam before it is delivered to the embossing cylinders. The resulting paper has an embossment height of greater than about 1450 μm.

Example 3

In another embodiment of the embossed paper products, two separate paper plies are made from the paper making process of Example 1. The two plies together have a MD stretch of 24% and a CD stretch of 13%. The two plies are then combined and embossed together by the deep-nested embossing process of Example 1. The resulting paper has an embossment height of greater than about 1000 μm.

Example 4

In another embodiment, three separate paper plies from the paper making process of Example 1 are combined to create a three ply web material. The two plies together have a MD stretch of 24% and a CD stretch of 13%. The two plies are then combined and embossed together by the deep-nested embossing process of Example 1. The resulting paper has an embossment height of greater than about 1000 μm.

Example 5

One example of a through-air dried, differential density structure, as described in U.S. Pat. No. 4,528,239 may be formed by the following process. The TAD carrier fabric of Example 1 is replaced with a carrier fabric consisting of 88.6 bi-axially staggered deflection conduits per cm, and a resin height of about 0.305 mm. The paper has a MD stretch of about 24% and a CD stretch of about 12%.

The paper is subjected to the embossing process of Example 1, and the resulting paper has an embossment height of greater than about 1450 μm and a finished product wet burst strength greater than about 70% of its unembossed wet burst strength.

Example 6

An alternative embodiment is a paper structure having single ply having a wet microcontraction greater than about 5% in combination with any known through air dried process. Wet microcontraction is described in U.S. Pat. No. 4,440,597. An example of this embodiment may be produced by the following process.

The wire speed is increased to about 706 meters per minute. The carrier fabric speed is about 635 meters per minute. The wire speed is 10% faster compared to the TAD carrier fabric so that the wet web foreshortening is 10%. The TAD carrier fabric of Example 1 is replaced by a carrier fabric having a 5-shed weave, 14.2 machine direction filaments and 12.6 cross-direction filaments per cm. The Yankee speed is about 635 meters per minute and the reel speed is about 572 meters per minute. The web is foreshortened 10% by wet microcontraction and an additional 10% by dry crepe. The resulting paper prior to embossing has a basis weight of about 33 gsm. The resulting paper has a MD stretch of about 27% and a CD stretch of about 12%?

This paper is further subjected to the embossing process of Example 1, and the resulting paper has an embossment height of greater than about 1000 μm and a finished product wet burst strength greater than about 70% of its unembossed wet burst strength.

Test Methods

The following describe the test methods utilized by the instant application in order to determine the values consistent with those presented herein.

% Elongation(Stretch)

Prior to tensile testing, the paper samples to be tested should be conditioned according to TAPPI Method #T402OM-88. All plastic and paper board packaging materials must be carefully removed from the paper samples prior to testing. The paper samples should be conditioned for at least 2 hours at a relative humidity of 48 to 52% and within a temperature range of 22 to 24° C. Sample preparation and all aspects of the tensile testing should also take place within the confines of the constant temperature and humidity room.

Discard any damaged product. Next, remove 5 strips of four usable units (also termed sheets) and stack one on top to the other to form a long stack with the perforations between the sheets coincident. Identify sheets 1 and 3 for machine direction tensile measurements and sheets 2 and 4 for cross direction tensile measurements. Next, cut through the perforation line using a paper cutter (JDC-1-10 or JDC-1-12 with safety shield from Thwing-Albert Instrument Co. of Philadelphia, Pa.) to make 4 separate stocks. Make sure stacks 1 and 3 are still identified for machine direction testing and stacks 2 and 4 are identified for cross direction testing.

Cut two 1 inch (2.54 cm) wide strips in the machine direction from stacks 1 and 3. Cut two 1 inch (2.54 cm) wide strips in the cross direction from stacks 2 and 4. There are now four 1 inch (2.54 cm) wide strips for machine direction tensile testing and four 1 inch (2.54 cm) wide strips for cross direction tensile testing. For these finished product samples, all eight 1 inch (2.54 cm) wide strips are five usable units (also termed sheets) thick.

For unconverted stock and/or reel samples, cut a 15 inch (38.1 cm) by 15 inch (38.1 cm) sample which is 8 plies thick from a region of interest of the sample using a paper cutter (JDC-1-10 or JDC-1-12 with safety shield from Thwing-Albert Instrument Co of Philadelphia, Pa.). Ensure one 15 inch (38.1 cm) cut runs parallel to the machine direction while the other runs parallel to the cross direction. Make sure the sample is conditioned for at least 2 hours at a relative humidity of 48 to 52% and within a temperature range of 22 to 24° C. Sample preparation and all aspects of the tensile testing should also take place within the confines of the constant temperature and humidity room.

From this preconditioned 15 inch (38.1 cm) by 15 inch (38.1 cm) sample which is 8 plies thick, cut four strips 1 inch (2.54 cm) by 7 inch (17.78 cm) with the long 7 (17.78 cm) dimension running parallel to the machine direction. Note these samples as machine direction reel or unconverted stock samples. Cut an additional four strips 1 inch (2.54 cm) by 7 inch (17.78 cm) with the long 7 (17.78 cm) dimension running parallel to the cross direction. Note these samples as cross direction reel or unconverted stock samples. Ensure all previous cuts are made using a paper cutter (JDC-1-10 or JDC-1-12 with safety shield from Thwing-Albert Instrument Co. of Philadelphia, Pa.). There are now a total of eight samples: four 1 inch (2.54 cm) by 7 inch (17.78 cm) strips which are 8 plies thick with the 7 inch (17.78 cm) dimension running parallel to the machine direction and four 1 inch (2.54 cm) by 7 inch (17.78 cm) strips which are 8 plies thick with the 7 inch (17.78 cm) dimension running parallel to the cross direction.

For the actual measurement of the tensile strength, use a Thwing-Albert Intelect II Standard Tensile Tester (Thwing-Albert Instrument Co. of Philadelphia, Pa.). Insert the flat face clamps into the unit and calibrate the tester according to the instructions given in the operation manual of the Thwing-Albert Intelect II. Set the instrument crosshead speed to 4.00 in/min (10.16 cm/min) and the 1st and 2nd gauge lengths to 2.00 inches (5.08 cm). The break sensitivity should be set to 20.0 grams and the sample width should be set to 1.00 inch (2.54 cm) and the sample thickness at 0.025 inch (0.0635 cm).

A load cell is selected such that the predicted tensile result for the sample to be tested lies between 25% and 75% of the range in use. For example, a 5000 gram load cell may be used for samples with a predicted tensile range of 1250 grams (25% of 5000 grams) and 3750 grams (75% of 5000 grams). The tensile tester can also be set up in the 10% range with the 5000 gram load cell such that samples with predicted tensiles of 125 grams to 375 grams could be tested.

Take one of the tensile strips and place one end of it in one clamp of the tensile tester. Place the other end of the paper strip in the other clamp. Make sure the long dimension of the strip is running parallel to the sides of the tensile tester. Also make sure the strips are not overhanging to the either side of the two clamps. In addition, the pressure of each of the clamps must be in full contact with the paper sample.

After inserting the paper test strip into the two clamps, the instrument tension can be monitored. If it shows a value of 5 grams or more, the sample is too taut. Conversely, if a period of 2-3 seconds passes after starting the test before any value is recorded, the tensile strip is too slack.

Start the tensile tester as described in the tensile tester instrument manual. The test is complete after the cross-head automatically returns to its initial starting position. Read and record the tensile load in units of grams from the instrument scale or the digital panel meter to the nearest unit.

If the reset condition is not performed automatically by the instrument, perform the necessary adjustment to set the instrument clamps to their initial starting positions. Insert the next paper strip into the two clamps as described above and obtain a tensile reading in units of grams. Obtain tensile readings from all the paper test strips. It should be noted that readings should be rejected if the strip slips or breaks in or at the edge of the clamps while performing the test.

If the percentage elongation at peak (% Stretch) is desired, determine that value at the same time tensile strength is being measured. Calibrate the elongation scale and adjust any necessary controls according to the manufacturer's instructions.

For electronic tensile testers with digital panel meters read and record the value displayed in a second digital panel meter at the completion of a tensile strength test. For some electronic tensile testers this value from the second digital panel meter is percentage elongation at peak (% stretch); for others it is actual inches of elongation.

Repeat this procedure for each tensile strip tested.

Calculations: Percentage Elongation at Peak (% Stretch)—For electronic tensile testers displaying percentage elongation in the second digital panel meter:

Percentage Elongation at Peak (% Stretch)=(Sum of elongation readings) divided by the (Number of readings made).

For electronic tensile testers displaying actual units (inches or centimeters) of elongation in the second digital panel meter:

Percentage Elongation at Peak (% Stretch)=(Sum of inches or centimeters of elongation) divided by ((Gauge length in inches or centimeters) times (number of readings made))

Results are in percent. Whole number for results above 5%; report results to the nearest 0.1% below 5%.

Embossment Height Test Method

Embossment height is measured using an Optical 3D Measuring System MikroCAD compact for paper measurement instrument (the "GFM MikroCAD optical profiler instrument") and ODSCAD Version 4.0 software available from GFMesstechnik GmbH, Warthestraβe E21, D14513 Teltow, Berlin, Germany. The GFM MikroCAD optical profiler instrument includes a compact optical measuring sensor based on digital micro-mirror projection, consisting of the following components:

A) A DMD projector with 1024×768 direct digital controlled micro-mirrors.

B) CCD camera with high resolution (1300×1000 pixels).

C) Projection optics adapted to a measuring area of at least 27×22 mm.

D) Recording optics adapted to a measuring area of at least 27×22 mm; a table tripod based on a small hard stone plate; a cold-light source; a measuring, control, and evaluation computer; measuring, control, and evaluation software, and adjusting probes for lateral (X-Y) and vertical (Z) calibration.

E) Schott KL1500 LCD cold light source.

F) Table and tripod based on a small hard stone plate.

G) Measuring, control and evaluation computer.

H) Measuring, control and evaluation software ODSCAD 4.0.

I) Adjusting probes for lateral (x-y) and vertical (z) calibration.

The GFM MikroCAD optical profiler system measures the height of a sample using the digital micro-mirror pattern projection technique. The result of the analysis is a map of surface height (Z) versus X-Y displacement. The system should provide a field of view of 27×22 mm with a resolution of 21 μm. The height resolution is set to between 0.10 μm and 1.00 μcm. The height range is 64,000 times the resolution. To measure a fibrous structure sample, the following steps are utilized:

1. Turn on the cold-light source. The settings on the cold-light source are set to provide a reading of at least 2,800 k on the display.
2. Turn on the computer, monitor, and printer, and open the software.
3. Select "Start Measurement" icon from the ODSCAD task bar and then click the "Live Image" button.
4. Obtain a fibrous structure sample that is larger than the equipment field of view and conditioned at a temperature of 73° F.±2° F. (about 23° C.±1° C.) and a relative humidity of 50%±2% for 2 hours. Place the sample under the projection head. Position the projection head to be normal to the sample surface.
5. Adjust the distance between the sample and the projection head for best focus in the following manner. Turn on the "Show Cross" button. A blue cross should appear on the screen. Click the "Pattern" button repeatedly to project one of the several focusing patterns to aid in achieving the best focus. Select a pattern with a cross hair such as the one with the square. Adjust the focus control until the cross hair is aligned with the blue "cross" on the screen.
6. Adjust image brightness by changing the aperture on the lens through the hole in the side of the projector head and/or altering the camera gains setting on the screen. When the illumination is optimum, the red circle at the bottom of the screen labeled "I.O." will turn green.
7. Select technical surface/rough measurement type.
8. Click on the "Measure" button. When keeping the sample still in order to avoid blurring of the captured image.
9. To move the data into the analysis portion of the software, click on the clipboard/man icon.

Click on the icon "Draw Cutting Lines." On the captured image, "draw" six cutting lines (randomly selected) that extend from the center of a positive embossment through the center of a negative embossment to the center of another positive embossment. Click on the icon "Show Sectional Line Diagram." Make sure active line is set to line 1. Move the cross-hairs to the lowest point on the left side of the computer screen image and click the mouse. Then move the cross-hairs to the lowest point on the right side of the computer screen image on the current line and click the mouse. Click on the "Align" button by marked point's icon. Click the mouse on the lowest point on this line and then click the mouse on the highest point of the line. Click the "Vertical" distance icon. Record the distance measurement. Increase the active line to the next line, and repeat the previous steps until all six lines have been measured. Perform this task for four sheets equally spaced throughout the Finished Product Roll, and four finished product rolls for a total of 16 sheets or 96 recorded height values. Take the average of all recorded numbers and report in mm, or μm, as desired. This number is the embossment height.

All measurements referred to herein are made at 23+/−1° C. and 50% relative humidity, unless otherwise specified.

All publications, patent applications, and issued patents mentioned herein are hereby incorporated in their entirety by reference. Citation of any reference is not an admission regarding any determination as to its availability as prior art to the claimed invention.

Herein, "comprising" means the term "comprising" and can include "consisting of" and "consisting essentially of."

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A web material, comprising one or more plies of a fibrous structure, the material having a first direction and a second direction which is perpendicular to the first direction and both first and second directions are in the plane of the web material, where the web material has different stretch characteristics in the first and second directions;

wherein the web material is embossed with a non-random pattern of deep nested embossments, formed by first embossing protrusions and second embossing protrusions, wherein the first embossing protrusions fit into the spaces between the second embossing protrusions, having an emboss height of greater than about 600 microns and having a height range of no greater than about 100 microns;

where the non-random pattern comprises a plurality of emboss regions where the pattern of embossments within an emboss region creates a localized primary line of stress on the paper as the web material was embossed and the plurality of emboss regions create primary lines of stress in more than one direction.

2. The web material of claim 1 wherein the web material is a tissue-towel paper product.

* * * * *

UNITED STATES PATENT AND TRADEMARK OFFICE

CERTIFICATE OF CORRECTION

PATENT NO. : 7,678,229 B2
APPLICATION NO. : 11/516892
DATED : March 16, 2010
INVENTOR(S) : Nicholas Jerome Wilke, II It is certified that error appears in the above-identified patent and that said Letters Patent is hereby corrected as shown below:

In Col. 19, line 1, "μcm" should be μm

Signed and Sealed this

Thirteenth Day of July, 2010

David J. Kappos

David J. Kappos
*Director of the United States Patent and Trademark Office*